United States Patent [19]

Slagley

[11] Patent Number: 4,572,487

[45] Date of Patent: Feb. 25, 1986

[54] BLAST FURNACE TUYERE WITH REPLACEABLE LINER

[75] Inventor: William E. Slagley, Crown Point, Ind.

[73] Assignee: Inland Steel Company, Chicago, Ill.

[21] Appl. No.: 608,868

[22] Filed: May 10, 1984

[51] Int. Cl.[4] ..... C21B 7/16

[52] U.S. Cl. ..... 266/270; 266/265

[58] Field of Search ..... 266/47, 265, 270

[56] References Cited

U.S. PATENT DOCUMENTS

| | | | |
|---|---|---|---|
| 1,362,702 | 12/1920 | Ives | 266/265 |
| 2,023,025 | 12/1935 | McKee | 266/270 |
| 3,031,178 | 4/1962 | White, Jr. | 266/265 |
| 3,558,119 | 1/1971 | Demalander | 266/270 |
| 3,831,918 | 8/1974 | Mori et al. | 266/270 |
| 4,043,542 | 8/1977 | Yamaoka et al. | 266/270 |

FOREIGN PATENT DOCUMENTS

| | | | |
|---|---|---|---|
| 47-3683 | 1/1972 | Japan | 266/270 |

*Primary Examiner*—L. Dewayne Rutledge
*Assistant Examiner*—Robert L. McDowell
*Attorney, Agent, or Firm*—Marshall, O'Toole, Gerstein, Murray & Bicknell

[57] ABSTRACT

A replaceable liner assembly for a blast furnace tuyere comprises a tubular, metallic liner which fits within the tuyere and a plurality of layers of refractory fiber paper sandwiched between the tubular liner and the inside surface of the tuyere. There are gas-tight seals between the liner and the tuyere at opposite ends thereof to prevent gas from entering the space occupied by the refractory fiber paper. The liner is composed of a metal which has a good resistance to oxidation and a lower thermal conductance and higher melting point than the metal of which the tuyere is composed.

30 Claims, 6 Drawing Figures

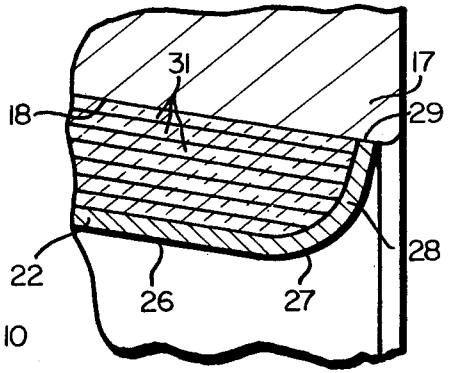
FIG. 5
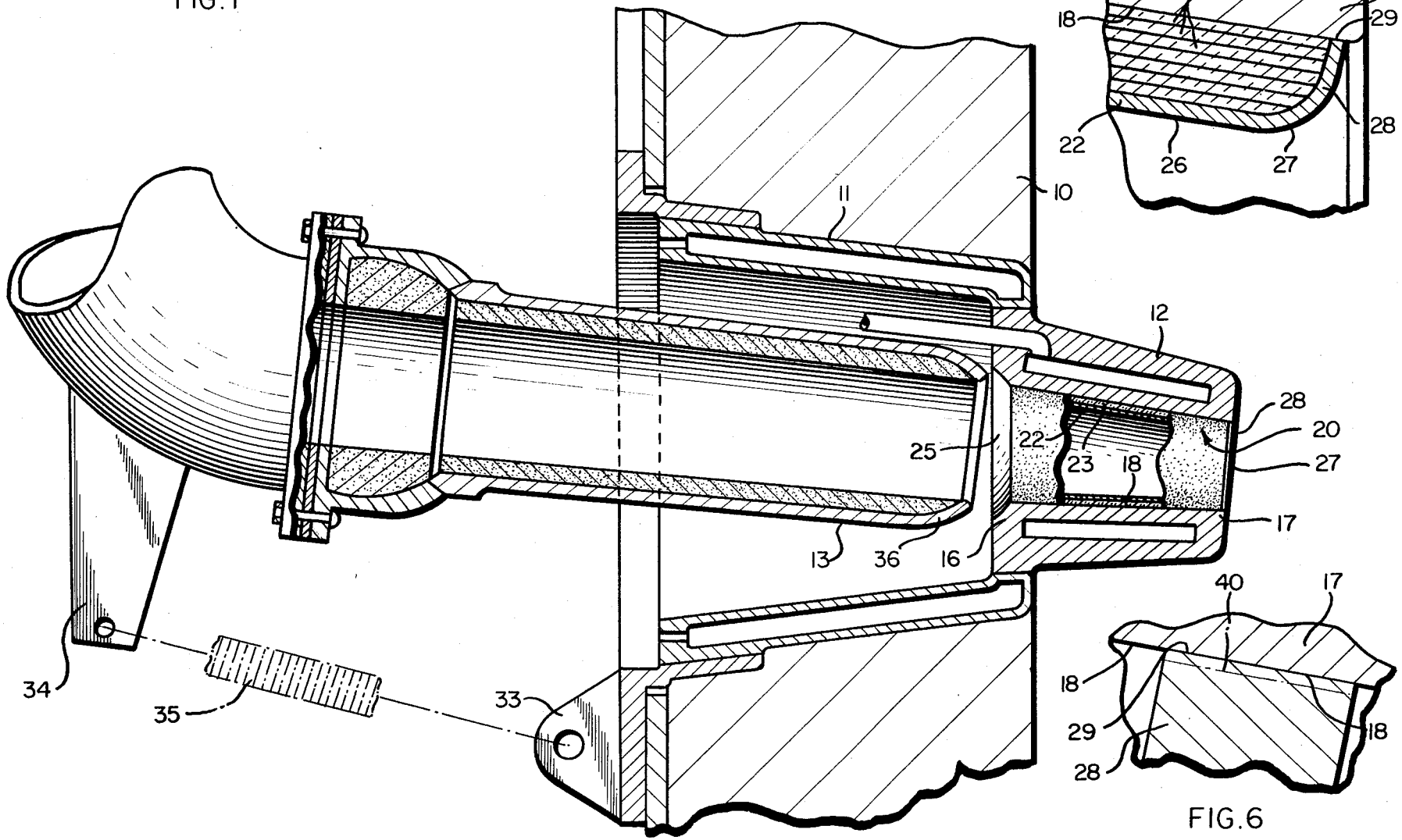
FIG. 1
FIG. 6

BLAST FURNACE TUYERE WITH REPLACEABLE LINER

BACKGROUND OF THE INVENTION

The present invention relates generally to blast furnaces for smelting iron ore, and more particularly to a blast furnace tuyere having a replaceable liner.

A blast furnace is a shaft-type furnace into the top of which are introduced iron ore, coke and limestone and into a lower hearth portion of which is introduced a blast of hot air, to perform the smelting operation. The blast of hot air is preheated in auxiliary stoves to a temperature in the range 1600°-2200° F. (871°-1204° C.) and introduced into the furnace proper through a plurality of tubular elements or nozzles called tuyeres. The tuyere is usually composed of copper and is cooled by water circulated through the tuyere to maintain the tuyere at a temperature of about 400°-600° F. (204°-315° C.).

A substantial amount of heat is lost from the hot air blast as it passes through the water-cooled tuyeres. There has been a substantial increase in blast furnace productivity over the years, through various improvements in blast furnace design and operation, and the increased productivity has required an increase in the quantity and circulation rate of cooling water circulated through the tuyeres. This in turn produces increased heat loss from the hot air blast as it passes through the tuyeres. This heat loss is undesirable because it reduces the operating temperature within the blast furnace.

A blast furnace may operate at flame temperatures in the range 3500°-4000° F. (1927°-2204° C.), for example. This is the temperature inside the blast furnace, in front of or inwardly of the tuyeres. There is an optimum operating flame temperature for a blast furnace, depending upon the make-up of the raw materials therein. If the actual temperature within the blast furnace drops below the optimum operating temperature, coke consumption must be increased to raise the temperature back to optimum, resulting in a substantial increase in operating expense. An alternative is to increase the temperature of the hot air blast upstream of the blast furnace tuyeres to compensate for the loss in heat resulting from the passage of the hot air blast through the water-cooled tuyeres. This, however, increases fuel consumption at the stoves in which the air blast is heated, and it also excessively increases the amount of maintenance required for refractory linings, valves, expansion joints, etc. in the equipment in which the hot air blast is transported from the stoves to the tuyeres.

Attempts have been made in the past to line the inside surface of the tuyere with a refractory material, and this has decreased the heat loss in the hot air blast. However, these refractory linings had drawbacks.

More particularly, in one arrangement, the inside surface of the tuyere was lined with a porous refractory material such as a castable material or a ramming mix. This resulted in a 25-30% decrease in the heat loss experienced with an unlined tuyere. However, the porous refractory material would not stay in place and had to be replaced very frequently, and this required removal of the tuyere from the furnace in turn requiring back drafting of the furnace. The resultant loss of furnace processing time offset any savings in coke consumption achieved by the utilization of the porous refractory lining on the inside surface of the tuyere.

Another arrangement employed a hard refractory liner in the form of a ceramic tube (e.g., composed of silicon carbide) which fit inside the tuyere, extended essentially the full length of the tuyere, and utilized a single layer of refractory fiber paper between the ceramic tube and the inside surface of the tuyere as a seating for the ceramic tube. This produced a 35-40% reduction in heat loss, but this arrangement also had a relatively short life in that the nose or inner end of the ceramic liner was exposed to the blast furnace interior and the liner wore away from the nose outwardly in a relatively short time. This produced the same replacement problem as did the use of porous refractory material.

There was an arrangement which attempted to cope with the problem of refractory wear initiating at the nose of the liner. That arrangement employed a recess in the inside surface of the tuyere. The recess had an inner end spaced in an outward direction from the nose of the tuyere, and a shortened silicon carbide liner was seated in the recess. The nose of the shortened liner was not directly exposed to the blast furnace interior but was protected therefrom by the tuyere wall at the inner end of the recess. This, however, decreased the reduction in heat loss down to about 25% compared to a 35-40% reduction when the silicon carbide liner extended the full length of the tuyere.

Still another arrangement employed a full length silicon carbide tube utilizing a seating composed of castable refractory material arranged in a layer between the silicon carbide tube and the inner surface of the tuyere. This produced a reduction in heat loss of only about 25-30%.

Refractory fiber paper has excellent insulating properties, but it is incapable of being self-retained along the inside surface of the tuyere.

SUMMARY OF THE INVENTION

In accordance with the present invention, there is provided a replaceable tuyere liner which overcomes the drawbacks and disadvantages of the prior art tuyere liners discussed above.

The present invention constitutes a liner assembly comprising a tubular, metallic liner and a plurality of layers of refractory fiber paper disposed around the outside of the tubular, metallic liner and sandwiched between the tubular, metallic liner and the inside surface of the tuyere. The reduction in heat loss is at least about 60% compared to an unlined tuyere.

The tubular, metallic liner is composed of a material having good oxidation resistance and a lower thermal conductance and higher melting point than the copper of which the tuyere is composed. A typical material for the liner is 309 stainless steel.

The plurality of layers of refractory fiber paper provides excellent insulation for the tuyere while the metallic, tubular member protects the tuyere against back-ups of slag and/or hot metal from the interior of the blast furnace.

The refractory fiber paper has a cellular construction, and this together with the layering of the refractory fiber paper contributes to the exceptional insulating properties of the present invention, compared to previous tuyere liner arrangements.

The refractory fiber paper is composed of refractory fibers held together with an organic binder. As a result of the high temperatures to which the refractory fiber paper can be exposed during blast furnace operation, there is an adverse affect on the organic binder causing particles of fiber to come loose from the paper. As long as the loose refractory fiber particles remain in the space between the tubular metallic liner and the inside surface of the tuyere, they can continue to perform an insulating function. However, the loose fiber particles can be transported from that space if gases are permitted to enter and leave that space. The resulting loss of refractory fiber particles from within that space reduces the insulating properties normally provided by the refractory fiber paper.

To prevent the problems described in the preceding paragraph, a liner assembly in accordance with the present invention comprises structure for providing a gas-tight seal at both the upstream and downstream ends of the liner assembly, thereby preventing gases from entering (or leaving) the space occupied by the refractory fiber paper. This prevents the transport outside that space of loose refractory fiber particles from within the space.

Other features and advantages are inherent in the structure claimed and disclosed or will become apparent to those skilled in the art from the following detailed description in conjunction with the accompanying diagrammatic drawings.

BRIEF DESCRIPTION OF THE DRAWINGS

FIG. 1 is a fragmentary, sectional view of a portion of a blast furnace showing a tuyere and a liner assembly in accordance with the present invention;

FIG. 5 is an enlarged, fragmentary, sectional view illustrating the downstream end of the liner assembly; and FIG. 6 is a further enlarged fragmentary view of a portion of the downstream end of the liner assembly.

DETAILED DESCRIPTION

Figure 2:
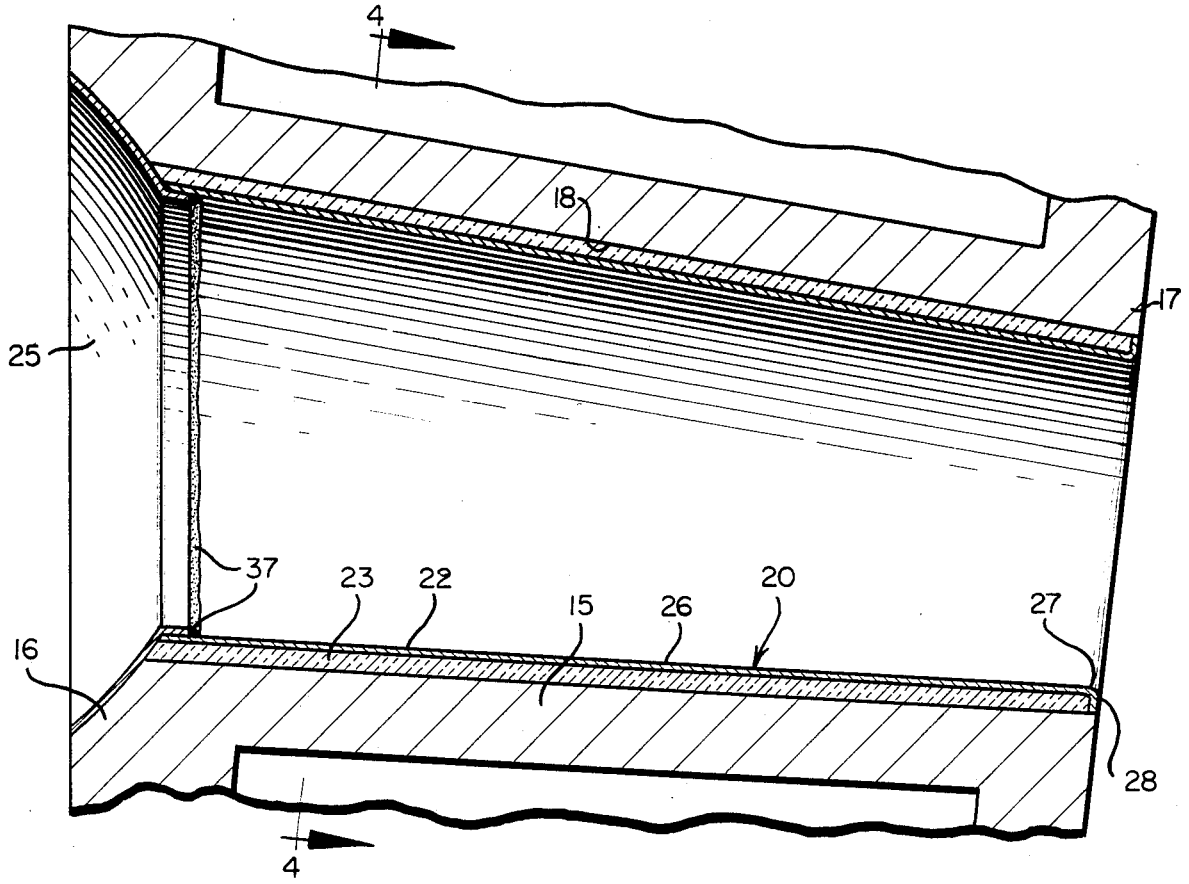
FIG. 2 is an enlarged sectional view illustrating the tuyere and liner assembly.

Referring initially to FIG. 1, there is shown a blast furnace wall 10 on which is mounted a water-cooled housing 11 at the inner or downstream end of which is located a tubular, metallic, water-cooled tuyere 12. Communicating with the upstream end 16 of tuyere 12 is the downstream end or nose 36 of a blowpipe 13 which conducts a hot-air blast to the tuyere. In FIG. 1, blowpipe nose 36 is shown spaced from tuyere upstream end portion 16, for purposes of illustration. Normally nose 36 is much closer to tuyere upstream end portion 16, as will be described subsequently in more detail.

Tuyere 12 extends into the interior of the furnace and is typically composed of copper. Tuyere 12 may be of conventional tuyere construction.

Referring to FIG. 2, the tuyere's upstream end portion 16 has a flared interior and is integral with a main tubular tuyere portion 15 terminating at a downstream nose portion 17. Tuyere 12 has an inside surface 18.

Figure 3:
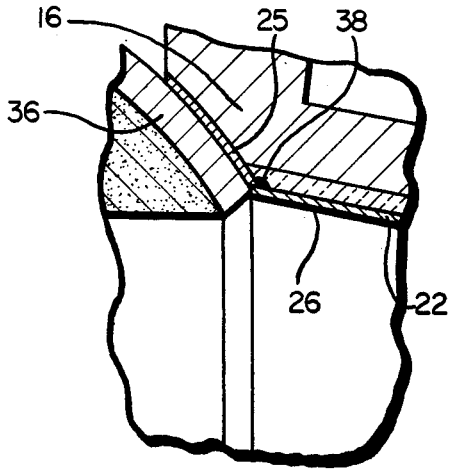
FIG. 3 is a fragmentary, sectional view illustrating the upstream end of the liner assembly.

Located within tuyere 12 is a replaceable liner assembly indicated generally at 20 and comprising a tubular, metallic liner 22 and a plurality of layers of refractory fiber paper 23 sandwiched between liner 22 and inside surface 18 of the tuyere's main portion 15. Referring to FIGS. 2, 3 and 5, tubular, metallic liner 22 comprises a flared, upstream end portion 25 connected to a main tubular portion 26 terminating at a downstream liner nose portion 27. Extending radially outwardly from liner nose portion 27 is a flange 28 which terminates at a peripheral flange edge 29 located a predetermined radial distance from liner nose portion 27. Flange 28 is continuous and undivided around the periphery of liner nose portion 27.

Referring to FIG. 5, refractory fiber paper 23 typically comprises 4–6 layers 31, 31 of refractory fiber paper wrapped around main liner portion 26 to a total paper thickness not substantially exceeding the radial dimension of flange 28.

When liner assembly 20 is inserted into tuyere 12, the flared upstream end portion 25 on liner member 22 nests within flared upstream end portion 16 on tuyere 12.

Tuyere 12 is water-cooled to a temperature typically in the range 400°–600° F. (204°–316° C.). The temperature on the inside of liner 22 corresponds to the temperature of the hot air blast, e.g., 1600°–2200° F. (871°–1204° C.), but the liner's nose portion 27 is exposed to the temperature inside the blast furnace, e.g., 3500°–4000° F. (1927°–2204° C.). There may also occur back-ups into the tuyere opening of slag or other hot material from inside the blast furnace, and on those occasions, the inside of liner 22 is temporarily subjected to a higher-than-usual temperature corresponding to that of the backed-up material. In addition, there may be occasions when there will be back flow of gases into the tuyere liner from the blast furnace interior, and this will subject the liner to temperatures of about 3200° F. (1760° C.), for example.

As noted above, refractory fiber paper 23 is composed of refractory fibers held together by an organic binder. It is believed that the organic binder is broken down or otherwise adversely affected by the high temperature to which the refractory fiber paper is subjected when the liner assembly is installed within the tuyere. This results in loose refractory fiber particles which can be transported out of the space occupied by refractory fiber paper 23 if there is a flow of gas into and out of that space. Such a flow of gas can occur as a result of normal fluctuations of pressure within the blast furnace. Therefore, unless there is a gas-tight seal at both the upstream and downstream ends of the liner assembly, the insulation between tubular, metallic liner 22 and tuyere 12 can be depleted by the transport of refractory fiber particles out of the space between metallic liner 22 and tuyere 12.

The present invention comprises structure at the tuyere's upstream end portion 16 and at the tubular liner's upstream end portion 25 for forming a gas-tight seal there. The present invention also comprises structure at the tuyere's downstream nose portion 17 and at the tubular liner's downstream nose portion 27 for forming a gas-tight seal there.

More particularly with respect to the gas-tight seal at the upstream end portions of the tuyere and liner, specific reference should be made to FIG. 1. Attached to the outside of blast furnace wall 10 is a bracket 33, and depending from blowpipe 13 is a bracket 34. Extending between brackets 33 and 34 is a coil spring illustrated diagrammatically in dash-dot lines at 35. One end of coil spring 35 is connected to bracket 34, and the other end of coil spring 35 is connected to bracket 33. As thus connected, coil spring 35 urges the nose 36 of blowpipe 13 inwardly in a downstream direction against flared upstream end portion 25 of liner 22 in turn urging the liner's upstream end portion into gas-tight sealing engagement with the tuyere's flared upstream end portion 16 (FIG. 3).

Figure 4:
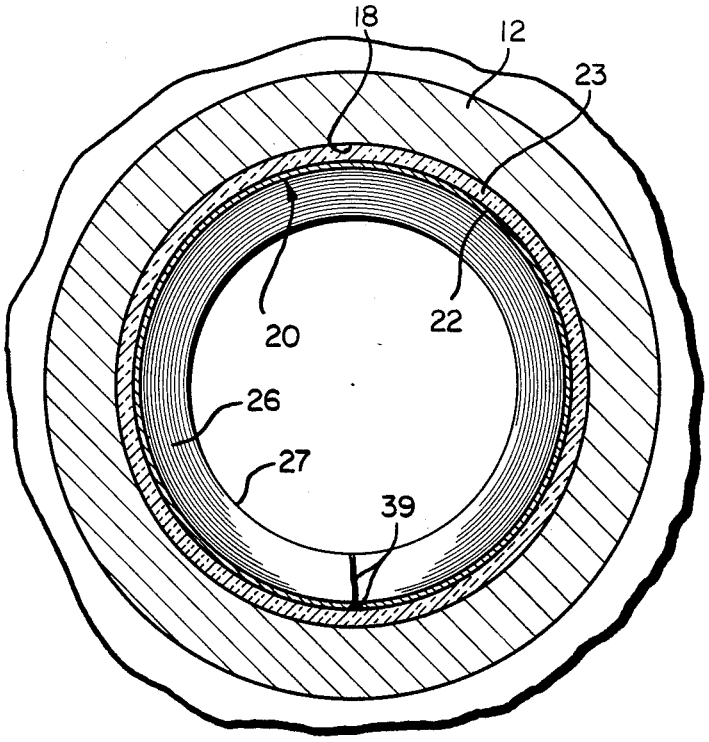
FIG. 4 is a sectional view taken along line 4—4 in FIG. 2.

Flared upstream end portion 25 on liner 22 is connected to main liner portion 26 with a gas-tight weld utilizing the weld arrangement shown at either 37 in FIG. 2 or at 38 in FIG. 3. Main liner portion 26 may be seamless or it may have a seam comprising a gas-tight weld 39 as shown in FIG. 4.

A gas-tight seal at the downstream nose portions 17, 27 of the tuyere and the liner is illustrated in FIGS. 5–6. Flange 28 on liner 22 has an outside diameter, shown by dash-dot line 40 in FIG. 6, which is less than the inside diameter of the tuyere's nose portion 17 at ambient temperature (70° F. (21° C.)). However, during blast furnace operation, water-cooled tuyere 12 undergoes a much smaller increase in temperature than does liner 22 which is uncooled and insulated from cooled tuyere 12 by refractory fiber paper 23. Typically, the temperature of tuyere 12 will increase about 330°–530° F. (183°–294° C.) above ambient temperature whereas liner 22 will undergo a temperature increase above ambient temperature in the range 1530°–2130° F. (850°–1183° C.). As a result, the outside diameter of flange 28 undergoes a much greater expansion in a radial direction than does the inside diameter of tuyere 12, and this is so even though the copper of which tuyere 12 is composed has a larger coefficient of expansion than does the metal of which liner 22 is composed (e.g., 309 stainless steel, columbium, tantalum or tungsten). This differential in radial expansion closes the small gap which exists at ambient temperature between the flange's peripheral edge 29 and inside surface 18 at the tuyere's nose portion.

For example, in one typical embodiment, wherein flange 28 is composed of 309 stainless steel and has a radial dimension of about 0.25 in. (6.35 mm), the gap between flange edge 29 and interior surface 18 at tuyere nose portion 17 is about 0.020 in. (0.51 mm) at ambient temperature. As tuyere 12 and liner 22 undergo heating to their respective temperatures, the inside diameter of the tuyere expands about 0.025 in. (0.64 mm) while the outside diameter of flange 28 expands about 0.075 in. (1.91 mm). The difference between the two expansions, 0.050 in. (1.27 mm), more than makes up for the original 0.020 in. (0.51 mm) gap between flange edge 29 and tuyere inside surface 18, and it jams flange edge 29 into the tuyere's inside surface 18 thereby providing the aforementioned gas-tight seal. As described above, the initial gap between flange edge 29 and tuyere inside surface 18 should be less than the difference in radial expansion between edge 29 and surface 18, to effect the gas-tight seal.

Inside surface 18 at tuyere nose portion 17 preferably is machined relatively smooth where it is abutted by peripheral flange edge 29 to enhance the seal there. Similarly, peripheral flange edge 29 preferably is machined relatively smooth to enhance the seal.

Thus liner 22 not only holds the layers of refractory fiber paper 23 against inside surface 18 of tuyere 12, but also, liner 22 minimizes contact between refractory fiber paper 23 and the gaseous atmosphere within the blast furnace there being structure on liner 22 cooperating with tuyere 12 to produce a gas-tight seal between inside surface 18 of tuyere 12 and liner 22, without attaching the liner to the tuyere, the liner being removable from the tuyere, as described in more detail below.

Liner 22 is typically composed of 309 stainless steel, but it may be composed of more exotic metals such as tantalum, tungsten or columbium, all of which melt above 4,000° F. (2204° C.), compared to a melting point of about 2700° F. (1482° C.) for 309 stainless steel which in turn is higher than the melting point of the copper of which tuyere 12 is composed (2000° F. (1093° C.)). The metal of which liner 22 is composed has good oxidation resistance relative to the hot air blast. For example, even stainless steel 309 does not oxidize until about 2000° F. (1093° C.).

A tuyere normally lasts less than six months. A liner 22 composed of 309 stainless steel will last somewhere between two and five months. It is desirable to have a liner which will last as long as the tuyere, thereby eliminating replacement of the liner or the need to operate the tuyere with a deteriorated liner. It is expected that a liner composed of the more exotic, higher melting point metals will last longer than a liner composed of 309 stainless steel. However, during at least the first two months of operation there will be essentially no difference between the protection provided by a liner 22 composed of 309 stainless steel and a liner 22 composed of the more exotic, higher melting point metals. It is only after two months of operation that the difference in protection may be material.

A liner composed of the more exotic, higher melting point metals will be initially more expensive, but because it will outlast a liner composed of the less expensive 309 stainless steel, it will pay for itself by reducing the heat loss at the tuyere during the third to sixth months of tuyere operation and/or by eliminating the more frequent replacement cost required when the liner is composed of 309 stainless steel.

Even if a liner must be replaced before the tuyere has to be replaced, the tuyere need not be removed to replace a liner assembly 20 in accordance with the present invention. All that is necessary is to withdraw blast pipe 13 from its engagement with the liner's flared portion 25, remove liner assembly 20 from within tuyere 12, insert a new liner assembly 20 and then return blast pipe 13 to its operative position.

During the replacement of liner assembly 20, tuyere 12 remains in place and is not removed. This is because liner assembly 20 has a slip fit relation with tuyere 12 and is not cemented or otherwise adhered within tuyere 12.

During replacement of a liner assembly 20, the blast furnace must be shut-off or back drafted, but the blast furnace down time for replacement of a liner assembly 20 is much shorter than the down time for removal of a tuyere 12 which is typically one-half to one hour.

Another advantage of a readily replaceable liner assembly in accordance with the present invention is that it may be used to change the effective inside diameter of the tuyere. It is sometimes desirable to change the velocity of the hot air blast, and this has been done in the past by changing the inside diameter of the tuyere, usually by changing tuyeres. With a liner assembly 20 in accordance with the present invention, it is not necessary to change the tuyere in order to change the inner diameter of the tuyere. One need merely select a liner 22 having the desired inside diameter. In such a case, the radial dimension of flange 28 would have to be large enough to abut the inside surface of the tuyere, and the layers of refractory fiber paper would have to be sufficiently numerous to fill the space between liner 22 and inside surface 18 of tuyere 12. Liner 22 is composed of relatively thin metal, e.g., 14–22 gauge or 0.075–0.030 in. (1.90–0.76 mm).

Therefore, not only does liner assembly 20 reduce the downtime for changing tuyere liners, it also reduces the number of different sizes of tuyeres required.

If liner assembly 20 wears out or deteriorates and is not replaced until the tuyere itself is replaced, the net effect is not too serious. The wear or deterioration would be principally at the nose of liner 22 and in the layers 31 of refractory fiber paper. What remained would still be better than operating the tuyere without any liner whatsoever. It would be less serious than if the tuyere had been lined with a ceramic liner which is much thicker than liner assembly 20 and the loss of which would have a material effect on hot air blast velocity. More specifically, liner assembly 20 has an inside diameter normally about 0.50 in. (12.7 mm) less than the inside diameter of the tuyere whereas, with a ceramic liner, the inside diameter is about 1.0–1.5 in. (25.4–38.1 mm) less than that of the tuyere.

The metallic liner 22 of the present invention will tolerate more physical abuse than the relatively brittle ceramic liners used in the past and more than the softer copper of which tuyere 12 is composed.

During operation of the blast furnace, there sometimes occur back-ups of slag or hot metal into the tuyere. The copper of which the tuyere is composed has a melting point of only about 2000° F. (1093° C.) whereas liner 22, even when composed of 309 stainless steel, has a melting point of about 2700° F. (1482° C.). Accordingly, liner 22 will protect the copper tuyere in the case of such back-ups.

The use of liner assembly 20 reduces heat loss at the tuyere about 60%. As a result, the temperature of the hot air blast when it enters the blast furnace from the tuyere is 40°–50° F. hotter than if liner assembly 20 had not been used. (In degrees Celsius, this would be an increase of 22°–27° C. assuming the hot air blast underwent an increase in temperature from 871° C. (1600° F.) to 893°–898° C. (1640°–1650° F.).) Therefore, the air blast need not be heated to such a high temperature in the stoves upstream of the blast furnace in order to deliver a given air blast temperature into the blast furnace. This reduces fuel consumption at the hot blast stoves, and it also reduces maintenance problems.

More particularly, when the hot blast temperature is over 1600° F. (871° C.), any further increase in temperature produces an excessive increase in maintenance problems on refractory linings, valves, expansion joints, etc. in the equipment in which the hot blast is transported to the blast furnace. Therefore, even a 40° F. reduction in hot air blast temperature will produce a significant reduction in maintenance problems.

As an alternative to utilizing the reduction in heat loss at the tuyeres as a vehicle for decreasing the fuel consumption in the hot blast stoves, the reduction in heat loss can be utilized to increase the operating temperature in the blast furnace (assuming the optimum operating temperature in the blast furnace has not previously been achieved). If there is no decrease in the amount of fuel burned in the hot blast stoves, the temperature delivered to the blast furnace will be 40°–50° F. (22°–27° C.) higher, and this will enable a very substantial saving in the amount of coke introduced into the blast furnace for a given quantity of other raw materials. The cost savings obtained by thus reducing the amount of coke will be substantially greater than the savings obtained by reducing the amount of fuel burned at the hot blast stoves, and that savings is, itself, very substantial.

309 stainless steel, a typical material for liner 22, has the following composition:

| Composition | |
|---|---|
| Element | Wt. % |
| carbon | 0.20 max. |
| manganese | 2.00 max. |
| silicon | 1.00 max. |
| chromium | 22.00–24.00 |
| nickel | 12.00–15.00 |
| iron | Balance |

The refractory fiber paper is generally available in rolls having a strip width at least as great as the length of tubular liner main portion 26 (e.g., about 18" (457.2 mm)). The refractory fiber paper is available in thicknesses of 0.02 in. (0.51 mm), 0.04 in. (1.02 mm) or 0.08 in. (2.04 mm).

Refractory fiber papers which may be utilized in the present invention are available commercially under the trademark Fiberfrax 970 Paper from Carborundum Resistant Materials Company or under the trademark Kaowool 2300 Paper from Babcock and Wilcox Insulating Products Division of McDermott Company.

Fiberfrax 970 Paper has the following composition and other properties.

| Composition | |
|---|---|
| Element | Wt. % |
| $Al_2O_3$ | 51.9 |
| $SiO_2$ | 47.9 |
| $Na_2O$ | 0.08 |
| $Fe_2O_3$ | 0.1 |

| Physical Properties | |
|---|---|
| Color | White |
| Continuous Use Limit | 1280° C. (2300° F.) |
| Melting Point | 1790° C. (3260° F.) |
| Fiber Diameter | 2–3 microns (mean) |
| Fiber Length | Up to 25 mm (1") |
| Density | 160–192 kg/m$^3$ (10–12 lb/ft.$^3$) |
| Specific Gravity | 2.73 g/cm$^3$ |
| Specific Heat | |
| 1093° C. (2000° F.) | 1130 Jkg °C. (.27 Btu lb °F.) |
| Dielectric Strength | 2756 volts/mm (70 volts/mil) |

The Fiberfrax 970 Paper comprises 94% refractory fiber having the composition indicated above and about 6% organic binder.

Kaowool 2300 Paper has the composition and properties set forth below.

| Composition | |
|---|---|
| Element | Wt. % |
| $Al_2O_3$ | 44.1 |
| $SiO_2$ | 49.8 |
| Trace inorganics (max.) | 0.6 |
| Binder | Balance |

| Physical Properties | |
|---|---|
| Color | White |

-continued

| Physical Properties | |
|---|---|
| Density | 192 kg/m$^3$ (12 lbs/ft$^3$) |
| Continuous use limit | 1280° C. max. (2300° F.) |
| Melting point | 1760° C. (3200° F.) |

The foregoing detailed description has been given for clearness of understanding only, and no unnecessary limitations should be understood therefrom, as modifications will be obvious to those skilled in the art.

I claim:

1. In a blast furnace, the combination comprising:

a tubular, metallic tuyere including a main tubular portion having an inside surface and terminating at a downstream nose portion;

a tubular, metallic liner for said tuyere;

said liner having a main liner portion which fits within the main portion of the tuyere and terminates at a downstream liner nose portion;

means on said liner cooperating with the tuyere for providing a gas-tight seal between said inside surface of the tuyere and said liner, without attaching the liner to the tuyere;

said means for providing the seal comprising a flange extending radially outwardly from the liner nose portion to a peripheral flange edge located a predetermined radial distance from the liner nose portion at ambient temperature, said flange being continuous around the periphery of the liner nose portion;

a plurality of layers of refractory fiber paper disposed around said main liner portion to a total paper thickness not substantially exceeding the radial dimension of said flange;

said layers of refractory fiber paper being sandwiched between said liner and said tuyere.

2. In a blast furnace as recited in claim 1 wherein:

said liner is composed of a metal having a substantially lower thermal conductance than that of the metal of which the tuyere is composed.

3. In a blast furnace as recited in claim 1 wherein:

said nose portion of the tuyere has a predetermined inside diameter;

and said flange on the liner is undivided and has a predetermined outside diameter which is less than said inside diameter of the tuyere's nose portion at ambient temperature but which expands during blast furnace operation so that the peripheral edge of said flange is in abutting relation with the inside surface of the tuyere's nose portion during blast furnace operation to provide a substantially gas-tight seal between the two nose portions during blast furnace operation.

4. In a blast furnace as recited in claim 3 wherein:

the inside surface at said nose portion of the tuyere is machined relatively smooth where it is abutted by the peripheral edge of the flange on the liner nose portion, to enhance the seal there.

5. In a blast furnace as recited in claim 4 wherein:

said peripheral edge on said flange is machined relatively smooth to enhance said seal.

6. In a blast furnace as recited in claim 1 wherein:

said peripheral edge comprises means cooperating with the inside surface at the tuyere's nose portion to provide a substantially gas-tight seal between the two nose portions.

7. In a blast furnace as recited in claim 6 wherein:

said tuyere has a flared upstream end portion connected to said main tubular portion of the tuyere;

said liner has a flared upstream end portion for nesting within said flared upstream end portion of the tuyere;

said flared portion of the liner is connected to said main liner portion;

and said combination comprises means normally urging said flared portion of the liner in a downstream direction against said flared portion of the tuyere to provide a substantially gas-tight seal between the two flared portions.

8. In a blast furnace as recited in claim 1 wherein:

said tubular metallic liner is composed of a metallic material resistant to oxidation at temperatures greater than 2000° F. (1093° C.) and having a melting point substantially exceeding 2500° F. (1371° C.).

9. In a blast furnace as recited in claim 1 wherein:

said metallic material has a melting point of at least about 4000° F. (2204° C.).

10. A liner assembly for a blast furnace tuyere having an inside surface, said liner assembly comprising:

a tubular, metallic liner;

said metallic liner having a main metallic liner portion terminating at a downstream nose portion;

means on said liner cooperating with the tuyere for providing a gas-tight seal between the inside surface of said tuyere and said liner, without attaching the liner to the tuyere;

said means for providing said gas-tight seal comprising a metallic flange extending radially outwardly from said nose portion to a peripheral flange edge located a predetermined radial distance from said nose portion at ambient temperature, said flange being continuous around the periphery of the liner nose portion;

and a plurality of layers of refractory fiber paper disposed around said main liner portion to a total paper thickness not substantially exceeding the radial dimension of said flange.

11. A liner assembly as recited in claim 10 wherein:

said liner is composed of a metal having a substantially lower thermal conductance than that of the metal of which the tuyere is composed.

12. A liner assembly as recited in claim 10 and for use with a tubular, metallic, blast furnace tuyere having a nose portion with a predetermined inside diameter, and wherein:

said flange on the liner is undivided and has a predetermined outside diameter which is less than the inside diameter of the tuyere's nose portion at ambient temperature but which expands during blast furnace operation so that the peripheral edge of said flange is in abutting relation with the inside surface of the tuyere's nose portion to provide a substantially gas-tight seal between the two nose portions during blast furnace operation.

13. A liner assembly as recited in claim 12 wherein:

said peripheral edge on said flange is machined relatively smooth to enhance said seal.

14. A liner assembly as recited in claim 10 and for use with a tubular, metallic tuyere including a main tubular portion having an inside surface and terminating at a downstream nose portion, and wherein:

said peripheral edge comprises means cooperating with said inside surface at the tuyere's nose portion to provide a substantially gas-tight seal between the two nose portions.

15. A liner assembly as recited in claim 14 and for use with a tubular, metallic tuyere having a flared upstream end portion, and wherein:

said metallic liner comprises a flared upstream end portion, connected to said main liner portion, and comprising means for cooperating with said flared, upstream end portion on the tuyere to provide a gas-tight seal between the two flared end portions.

16. A liner assembly as recited in claim 10 wherein:

said tubular metallic liner is composed of a metallic material resistant to oxidation at temperatures greater than 2000° F. (1093° C.) and having a melting point substantially exceeding 2500° F. (1371° C.).

17. A liner assembly as recited in claim 10 wherein:

said metallic material has a melting point of at least about 4000° F. (2204° C.).

18. In a blast furnace, the combination comprising:

a tubular metallic tuyere including a main tubular portion terminating at a downstream nose portion;

said main tubular portion having an inside surface;

a plurality of layers of refractory fiber paper lining said inside surface;

protective means for holding said layers of refractory fiber paper against said inside surface and for minimizing contact between said refractory fiber paper and the atmosphere within said blast furnace;

and means on said protective means cooperating with the tuyere for providing a gas-tight seal between said protective means and the inside surface of said tuyere without attaching said protective means to the tuyere.

19. In a blast furance as recited in claim 18 wherein said protective means comprises:

a tubular, protective member which cooperates with said main tubular portion of the tuyere to sandwich therebetween said layers of refractory fiber paper.

20. In a blast furnace as recited in claim 19 wherein:

said tubular, protective member is composed of a metallic material substantially resistant to oxidation by the hot air blast introduced into said furnace and having a melting point exceeding the temperature to which the inside of the protective member is subjected during normal operation of the blast furnace.

21. In a blast furnace as recited in claim 19 wherein:

said tubular, protective member has a downstream nose portion and is composed of a metallic material having a melting point substantially exceeding the temperature to which the protective member's nose portion is subjected during normal operation of the blast furnace.

22. In a blast furnace as recited in claim 19 wherein:

said tubular, protective member has an upstream end portion and a downstream nose portion;

said tuyere has an upstream end portion;

and said means for providing said gas-tight seal comprises means at the downstream nose portion of the tuyere and the protective member for forming a gas-tight seal there.

23. In a blast furnace as recited in claim 22 wherein said means for providing the gas-tight seal further comprises:

means at the upstream end portions of the tuyere and the protective member for forming a gas-tight seal there.

24. In a blast furnace as recited in claim 19 wherein:

said tubular, protective member comprises means cooperating with said tuyere to permit the removal of said protective member from within said tuyere without removing the tuyere from the blast furnace.

25. In a blast furnace as recited in claim 19 wherein:

said tubular protective member is composed of a metallic material having a lower thermal conductance than the metal of which the tuyere is composed.

26. In a blast furnace as recited in claim 1 wherein:

said liner is removable from within said tuyere.

27. A liner assembly as recited in claim 10 wherein:

said liner is removably mountable within said tuyere.

28. In a blast furnace as recited in claim 19 wherein:

said tubular, protective member is removably mounted within said tuyere.

29. In further combination with the combination recited in claim 28:

at least one other tubular protective member removably mountable within said tuyere as a replacement for said first recited tubular protective member;

said other tubular protective member having an inside diameter different than that of said first recited tubular protective member so as to change the effective inside diameter of said tuyere when said other tubular member replaces the first recited tubular member within the tuyere;

said other tubular protective member comprising means cooperating with said main tubular portion of the tuyere to sandwich therebetween said layers of refractory fiber paper.

30. In a blast furnace as recited in claim 22 wherein;

said means at the downstream nose portion of the tubular, protective member comprises flange means extending radially outwardly therefrom for engaging with the inside surface of the tuyere's downstream nose portion;

said flange means being continuous around the periphery of the tubular protective member's nose portion.

* * * * *